US007073482B2

(12) United States Patent
Kirchberger

(10) Patent No.: US 7,073,482 B2
(45) Date of Patent: Jul. 11, 2006

(54) FOUR-CYCLE INTERNAL COMBUSTION ENGINE

(76) Inventor: Roland Kirchberger, Dr. Emperger-Weg 28/1/3, Graz (AT) A 8052

( * ) Notice: Subject to any disclaimer, the term of this patent is extended or adjusted under 35 U.S.C. 154(b) by 425 days.

(21) Appl. No.: 10/432,851

(22) PCT Filed: Nov. 28, 2001

(86) PCT No.: PCT/AT01/00384

§ 371 (c)(1),
(2), (4) Date: May 28, 2003

(87) PCT Pub. No.: WO02/44528

PCT Pub. Date: Jun. 6, 2002

(65) Prior Publication Data

US 2004/0099241 A1 May 27, 2004

(30) Foreign Application Priority Data

Nov. 30, 2000 (AT) ..... A 2011/2000

(51) Int. Cl.
*F02B 75/02* (2006.01)

(52) U.S. Cl. ..... 123/317; 123/196 R

(58) Field of Classification Search ..... 123/317, 123/196 R

See application file for complete search history.

(56) References Cited

U.S. PATENT DOCUMENTS 3,672,172 A 6/1972 Hammond
5,291,866 A * 3/1994 Kosa ..... 123/317
5,758,610 A 6/1998 Park

FOREIGN PATENT DOCUMENTS

| | | |
|---|---|---|
| DE | 3731250 | 10/1988 |
| DE | 3832013 | 3/1990 |
| DE | 3935789 | 5/1991 |
| DE | 19704594 | 8/1998 |
| EP | 0376130 | 7/1990 |
| EP | 0628704 | 12/1994 |
| EP | 0631040 | 12/1994 |
| JP | 02233827 A * | 9/1990 |
| JP | 08218841 | 8/1996 |
| WO | WO 01/81740 | 11/2001 |

* cited by examiner

*Primary Examiner*—Tony M. Argenbright
*Assistant Examiner*—Katrina Harris
(74) *Attorney, Agent, or Firm*—Collard & Roe, P.C.

(57) ABSTRACT

A four-stroke internal combustion engine is described, with at least one cylinder(9), a crankcase (3) which forms a crankcase pump and is connected via a valve (15, 18) each to an air manifold (16) for fresh air on the one hand and to an intake manifold (17) connecting the crankcase (3) with an intake port (11) of the cylinder (9) on the other hand, and with a reservoir (25) for lubricating oil arranged on a conveying device (26) for lubricating oil, with an oil circulation comprising the crankcase (3) as well as an oil separator (19) provided in the intake manifold (17) and with a device (23) for injecting fuel into the intake manifold (17) or into the combustion chamber (29) of the cylinder (9). In order to provide advantageous constructional conditions it is proposed that the conveying device (26) connected to the reservoir (25) comprises a duct (27) for injecting lubricating oil into the crankcase (3) and that the intake manifold leads to the oil separator (19) by circumventing the reservoir (25).

5 Claims, 2 Drawing Sheets

FOUR-CYCLE INTERNAL COMBUSTION ENGINE

CROSS REFERENCE TO RELATED APPLICATIONS

Applicant claims priority under 35 U.S.C. §119 of AUSTRIAN Application No. A 2011/2000 filed on 30 Nov. 2000. Applicant also claims priority under 35 U.S.C. §365 of PCT/AT01/00384 filed on 28 Nov. 2001. The international application under PCT article 21(2) was not published in English.

FIELD OF THE INVENTION

The invention relates to a four-stroke internal combustion engine with at least one cylinder, a crankcase which forms a crankcase pump and is connected via a valve each to an air manifold for fresh air on the one hand and to an intake manifold connecting the crankcase with an intake port of the cylinder on the other hand, and with a reservoir for lubricating oil arranged on a conveying device for lubricating oil, with an oil circulation comprising the crankcase as well as an oil separator provided in the intake manifold and with a device for injecting fuel into the intake manifold or into the combustion chamber of the cylinder.

DESCRIPTION OF THE PRIOR ART

In order to supercharge the combustion air which is taken in in four-stroke internal combustion engines with the help of a crankcase pump, it is known (EP 0 631 040 A1) to supply the crankcase with a fuel-air mixture which is enriched with lubricating oil which after its supercharging through the crankcase pump is supplied to the combustion chamber of the cylinder. The disadvantageous aspect in these known four-stroke internal combustion engines is, however, that the lubricating oil conveyed with the fuel-air mixture into the combustion chamber of the cylinder is combusted, leading to a higher pollutant load of the exhaust gases. Moreover, as a result of the fuel introduced into the crankcase there is a reduced lubricating effect within the crankcase in comparison with a pure oil lubrication. These disadvantages are avoided in another known construction (U.S. Pat. No. 5,758,610 A), in which merely fresh air is sucked into the crankcase, whereas the fuel injection only occurs in the region of the intake port of the cylinder which is connected with the crankcase via an intake manifold. Because an oil separator is arranged in the intake manifold between the crankcase and the intake port in the direction of flow of the supercharged combustion air before the fuel injection, it can be assumed that the combustion chamber is supplied with a fuel-air mixture without lubricating oil from the crankcase because any lubricating oil entrained from the crankcase with the supercharged combustion air is separated through the oil separator from the combustion air stream and flows back through the intake manifold into the crankcase. The provision of a conventional oil lubrication requires an adequate quantity of lubricating oil within the crankcase. For this reason, this provides unfavourable constructional preconditions for the crankcase pump where the ratio between the volume of the crankcase and the displacement volume of the pistons should be as small as possible.

In order to improve the constructional conditions for the crankcase pump it is finally known (DE 37 31 250 C1) to separate the crankcase from an oil sump for receiving lubricating oil which is pumped in form of a conventional forced oil lubrication from the oil sump to the individual bearing points. The supercharged combustion air which is loaded with lubricating oil from the crankcase is supplied to the oil sump via a check valve where oil separation occurs due to the deflection of air around baffle plates. The remaining oil is separated from the combustion air in an oil separator which is interposed in the intake manifold between the oil sump and the intake port of the cylinder. As a result of the forced oil lubrication, a comparatively large quantity of oil is incorporated in the combustion air stream, which increases the efforts placed on the required oil separation. The thus concomitant pressure losses occur at the expense of the supercharging of the combustion air. An additional factor is that by including the oil sump in the combustion air guidance, the overall volume for the supercharged combustion air is increased and thus the acceleration behaviour of the internal combusting engine is disadvantageously influenced. Since with respect to the subsequent oil separation the lubricating oil should be removed from the crankcase as quickly as possible in order to avoid any swirling of the lubricating oil and thus any unnecessary loading of the removed combustion air with oil, it is necessary to ensure a respectively large oil rotation in the oil circulation.

SUMMARY OF THE INVENTION

The invention is thus based on the object of providing a four-stroke internal combustion engine of the kind mentioned above in such a way that despite advantageous constructional preconditions for the crankcase pump a favourable oil lubrication can be secured within the crankcase with a comparatively low amount of oil without having to fear any disadvantageous influences on the acceleration behaviour of the engine.

The invention achieves this object in such a way that the conveying device connected to the reservoir comprises a duct for injecting lubricating oil into the crankcase and that the intake manifold leads to the oil separator by circumventing the reservoir.

Since lubricating oil will be injected into the crankcase, a sufficient supply of the moved parts with lubricating oil can be guaranteed without needing an oil bath or any forced oil lubrication. This means that comparatively low quantities of oil are required which are distributed within the crankcase by means of the fresh air sucked into the crankcase. Due to the swirling of the lubricating oil which is required for the lubrication of the lubricating points within the region of the crankcase, the lubricating oil can have a long dwell time within the crankcase, which again reduces the required oil throughput. Advantageous separation conditions are still obtained due to the low oil quantities, so that it is possible to make do with one oil separator in the air manifold between crankcase and the intake port of the cylinder. The simple guidance of the intake manifold from the crankcase to the intake port of the cylinder via the oil separator by circumventing the reservoir for lubricating oil avoids higher pressure losses and ensures a favourable acceleration behaviour of the combustion engine due to the limited overall volume for the supercharged combustion air.

Lubricating oil from the oil separation chamber of the oil separator can be recirculated via a recirculating line to the reservoir for the lubricating oil, so that the oil circulation closes via said reservoir. Another possibility is connecting the oil separator with the crankcase per se via a recirculating line which starts from an oil separation chamber, leading to an oil circulation which merely comprises the crankcase and the oil separator. The conveying device which is connected to the reservoir and comprises the duct for injecting lubricating oil into the crankcase is merely used in this case for compensating losses of lubricating oil. Since it must be expected that a slight loading of the lubricating oil in the crankcase with fuel which reaches the crankcase from the cylinder via the piston gasket occurs, such an oil circulation offers the advantage by circumventing the reservoir that the lubricating oil in the oil circulation which is loaded by fuel can continually be supplied with fresh, unloaded oil, whereas in an oil circulation via the reservoir it is necessary to expect a loading of the lubricating oil with fuel in the reservoir.

The relevant aspect for a low consumption of lubricating oil is a favourable separation of the lubricating oil from the supercharged combustion air stream. The demanded high separation rate can advantageously be ensured when the oil separator consists of a cyclone separator.

Although the lubricating oil can be injected at different locations into the crankcase in order to supply components with a high need for lubrication in a preferred manner, especially favourable injection conditions are obtained when the duct for the lubricating oil is at least connected to a nozzle provided in the region of the orifice of the supply manifold for the fresh air. An additional distribution effect can be achieved for the lubricating oil through the fresh air that flows into the crankcase.

BRIEF DESCRIPTION OF THE DRAWINGS

The invention is shown in closer detail by reference to the enclosed drawings, wherein.

DESCRIPTION OF THE PREFERRED EMBODIMENTS

Figure 1:
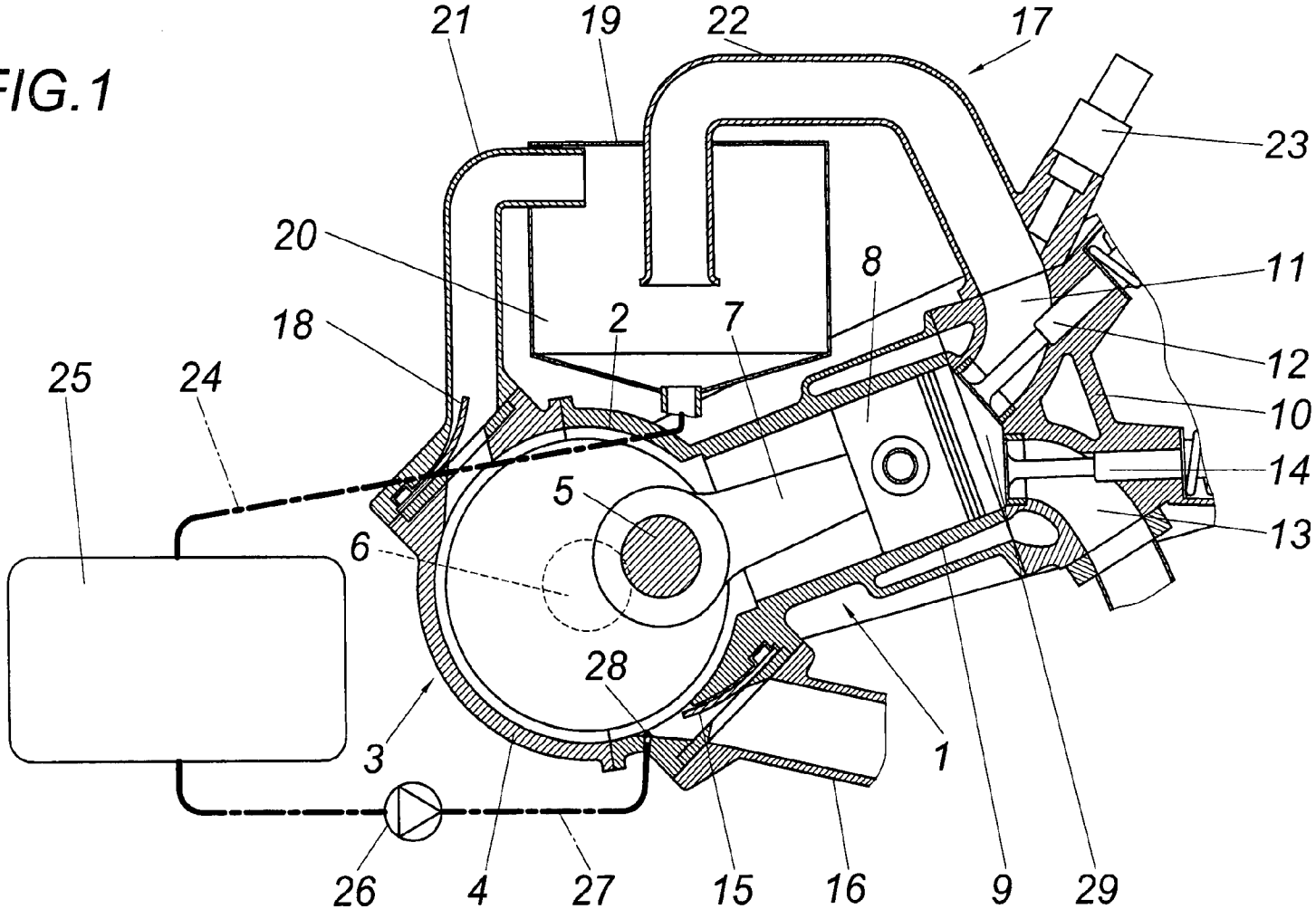
FIG. 1 shows a four-stroke internal combustion engine in accordance with the invention in a schematic sectional view.

In accordance with the illustrated embodiments of a four-stroke internal combustion engine in accordance with the invention, the cylinder block 1 forms the one part 2 of a crankcase 3 whose other part is arranged as a cover 4. A connecting rod 7 of the piston 8 of at least one cylinder 9 is held on the crank pin 5 of the crankshaft 6 held in the crankcase 3, with the cylinder head 10 of cylinder 9 comprising at least one intake port 11 with an intake valve 12 and an exhaust port 13 with an exhaust valve 14.

In combination with the piston 8, the crankcase 3 forms a crankcase pump by means of which fresh air is sucked in and compressed. For this purpose the crankcase 3 is connected to an air manifold 16 for fresh air via a check valve 15. On the circumferential side which is opposite of the air manifold 16 there is connected to the crankcase 3 an intake manifold 17 for the combustion air which is supercharged in the crankcase 3 via a check valve 18. An oil separator 19 is interposed in said intake manifold 17 which is connected with the intake port 11, which oil separator is arranged as a cyclone separator with an oil separation chamber 20 into which the branch 21 of the intake manifold 17 opens tangentially, which branch 21 comes from the crankcase 3, whereas the connecting branch 22 to the intake port 11 ensures a central air exit from the oil separation chamber 20. In the adjoining region of the connecting branch 22 of the intake manifold 17 to the intake port 11 there is provided an injection device 23 for fuel, so that a supercharged fuel-air mixture is sucked in via the intake port 11.

According to the embodiment according to FIG. 1, a recirculating line 24 leads from the oil separation chamber 20 to a reservoir 25 for lubricating oil which revolves in an oil circulation which comprises a line 27 which can be charged by a conveying device 26 and which supplies a nozzle 28 with lubricating oil, which nozzle projects in the region of the orifice of the feed line 16 into the crankcase 3. The lubricating oil, which may be injected into the crankcase through several nozzles and whose distribution in the crankcase 3 is supported by the fresh air that is sucked in, ensures sufficient oil lubrication within the crankcase 3. Since a part of the lubricating oil injected via the nozzle 28 is removed from the crankcase with the supercharged combustion air via the branch 21 of the air manifold and is separated in the oil separator 19, the oil lubrication within the crankcase is ensured which despite the closely packed conditions which are favourable to the pumping conditions ensures a favourable lubrication with oil within the crankcase 3.

Figure 2:
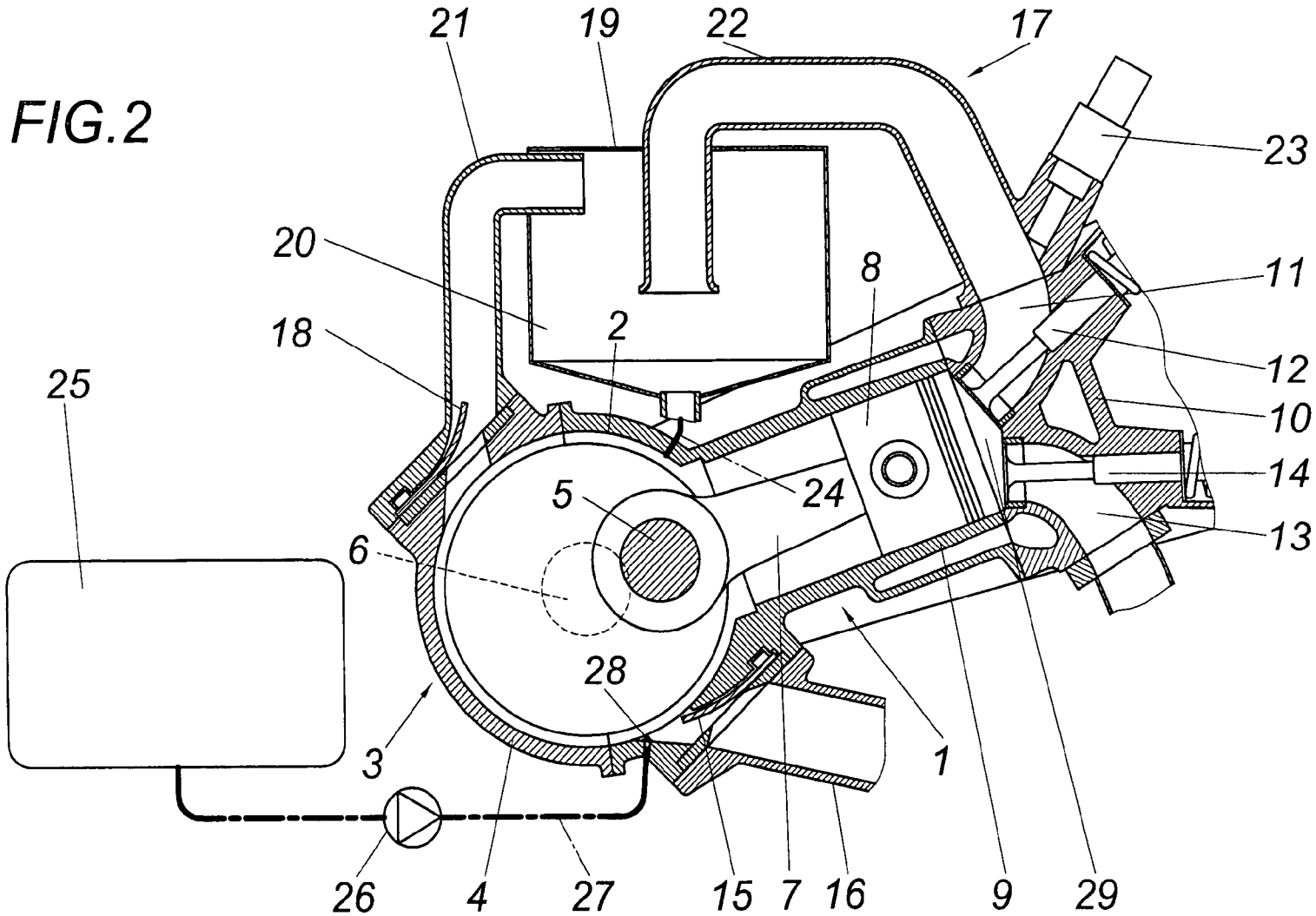
FIG. 2 shows an embodiment of a four-stroke internal combustion engines in a representation corresponding to FIG. 1.

In contrast to the embodiment according to FIG. 1, the recirculating line 24 according to the embodiment of FIG. 2 does not open into the reservoir 25, but into the crankcase 3 per se, so that the oil circulation closes through the crankcase 3 by circumventing the reservoir 25 via the oil separator 19 with the advantage that lubricating oil injected from the reservoir 25 into the crankcase 3 is not loaded with fuel which reaches the crankcase 3 from the cylinder 9.

It is understood that the invention is not limited to the explained embodiment. Consequently, the fuel injection could be provided not in the region of the intake manifold 17, but instead directly into the combustion chamber 29. Moreover, the injection of lubricating oil in the region of the orifice of the air manifold 16 for fresh air is not mandatory. The reservoir 25 for the lubricating oil could be a part of a further oil circulation of the engine. The conveying device 26 for the lubricating oil can also make do without the oil pump. In such a case the oil conveyance could be ensured through pressure pulsation.

The invention claimed is:

1. A four-stroke internal combustion engine with at least one cylinder (9), a crankcase (3) which forms a crankcase pump and is connected via a valve (15, 18) each to an air manifold (16) for fresh air on the one hand and to an intake manifold (17) connecting the crankcase (3) with an intake port (11) of the cylinder (9) on the other hand, and with a reservoir (25) for lubricating oil arranged on a conveying device (26) for lubricating oil, with an oil circulation comprising the crankcase (3) as well as an oil separator (19) provided in the intake manifold (17) and with a device (23) for injecting fuel into the intake manifold (17) or into the combustion chamber (29) of the cylinder (9), characterized in that the conveying device (26) connected to the reservoir (25) comprises a duct (27) for injecting lubricating oil into the crankcase (3) and that the intake manifold leads to the oil separator (19) by circumventing the reservoir (25).

2. A four-stroke internal combustion engine as claimed in claim 1, characterized in that the oil separator (19) is connected with the reservoir (25) via a recirculating line (24) starting from an oil separation chamber (20).

3. A four-stroke internal combustion engine as claimed in claim 1, characterized in that the oil separator (19) is connected with the crankcase (3) via a recirculating line (24) starting from an oil separation chamber (20).

4. A four-stroke internal combustion engine as claimed in claim 1, characterized in that the oil separator (19) consists of a cyclone separator.

5. A four-stroke internal combustion engine as claimed in claim 1, characterized in that the duct (27) for the lubricating oil is connected at least to one nozzle (28) provided in the region of the orifice of the air manifold (16) for the fresh air.

* * * * *